US010604296B2

(12) United States Patent
Kick

(10) Patent No.: US 10,604,296 B2
(45) Date of Patent: Mar. 31, 2020

(54) CONTAINER

(76) Inventor: Merrilee Kick, Carrollton, TX (US)

( * ) Notice: Subject to any disclaimer, the term of this patent is extended or adjusted under 35 U.S.C. 154(b) by 0 days.

(21) Appl. No.: 12/762,934

(22) Filed: Apr. 19, 2010

(65) Prior Publication Data

US 2011/0253720 A1 Oct. 20, 2011

(51) Int. Cl.
*B65D 1/16* (2006.01)
*B65D 17/28* (2006.01)

(52) U.S. Cl.
CPC ..... *B65D 1/165* (2013.01); *B65D 1/16* (2013.01); *B65D 17/4012* (2018.01)

(58) Field of Classification Search
CPC ..... B65D 2501/0009; B65D 2501/24; B65D 2501/14; B65D 2501/00; B65D 1/14; B65D 1/12; B65D 1/10; B65D 1/165
USPC ..... 220/608, 269, 669; D9/518
See application file for complete search history.

(56) References Cited

U.S. PATENT DOCUMENTS 2,745,642 A * 5/1956 Hermann ..... A47J 43/24 206/1.5
3,179,036 A * 4/1965 Luker ..... 249/134
3,314,569 A * 4/1967 Seiferth ..... B65D 17/4012 220/270
D254,716 S * 4/1980 Mascia ..... D9/518
4,936,482 A * 6/1990 Gallagher et al. ..... 220/802
5,407,086 A * 4/1995 Ota ..... B65D 1/0223 215/370
6,793,094 B2 * 9/2004 Turnbough ..... A47G 19/2272 215/11.1
7,051,892 B1 * 5/2006 O'Day, Jr. ..... 215/383
7,731,053 B2 * 6/2010 Ivey ..... 220/603

FOREIGN PATENT DOCUMENTS

JP 02032248 A * 2/1990

* cited by examiner

*Primary Examiner* — James N Smalley
*Assistant Examiner* — Madison L Poos
(74) *Attorney, Agent, or Firm* — Haynes and Boone, LLP

(57) ABSTRACT

A container for storing a liquid or a solid may include a container body having a container side wall and a container bottom and a container lid having a pop top arm to pivot and cooperate with a weakened area to provide access to the interior of the container body. The container body may be formed from plastic and the container lid is formed from metal, and the container body may include a vertical neck. The container body may include a lip, and the bottom wall may include a center protrusion. The bottom wall may include a depression, and the bottom wall may include a radial extending depression.

4 Claims, 9 Drawing Sheets

Container Shape

Thickness of Sidewalls & Volume

View:
Bottom of Container

CONTAINER

FIELD OF THE INVENTION

The present invention relates to containers and more particularly to a container having a body which may be formed from plastic and a lid which may be formed from metal.

BACKGROUND

Containers having an easy-open-end have been used with a metal lid and container in order to provide a source of merchandising beer and soda for a number of years. These metal containers are formed from cutting metal and folding the metal to an appropriate shape. Metal however does not lend itself well to being molded, and making a new shape by designing a mold out of the sheet of metal is time-consuming and expensive. Thus, it is difficult to achieve any type of design in order to increase the desirability of the package/container with a metal container. However, the pop top lid is very popular with consumers and fairly inexpensive to purchase. Plastic containers have been molded into various shapes and may include various designs in order to increase the attractiveness of the container.

SUMMARY

A container for storing a liquid or a solid may include a container body having a container side wall and a container bottom, and may include a container lid having an easy-open "pop-top arm" which cooperates with a weakened (scored metal) area which provides access to the interior of the container body. The container may also operate with no lid.

The container body may be formed from plastic and the container lid is formed from metal, and the container body may include a vertical or slightly angled neck. The container body may include a lip, and the bottom wall may include a center protrusion or concave shape. The bottom wall may include a depression, and the bottom wall may include a radial extending depression.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The present invention combines the flexibility and desirability of a container body 105 which may be formed from molding plastic or other appropriate material and a metal lid to cooperate with the container body which may include a pop top (or easy-open) lid 131 to provide access to the user of the contents of the container body.

Figure 1:
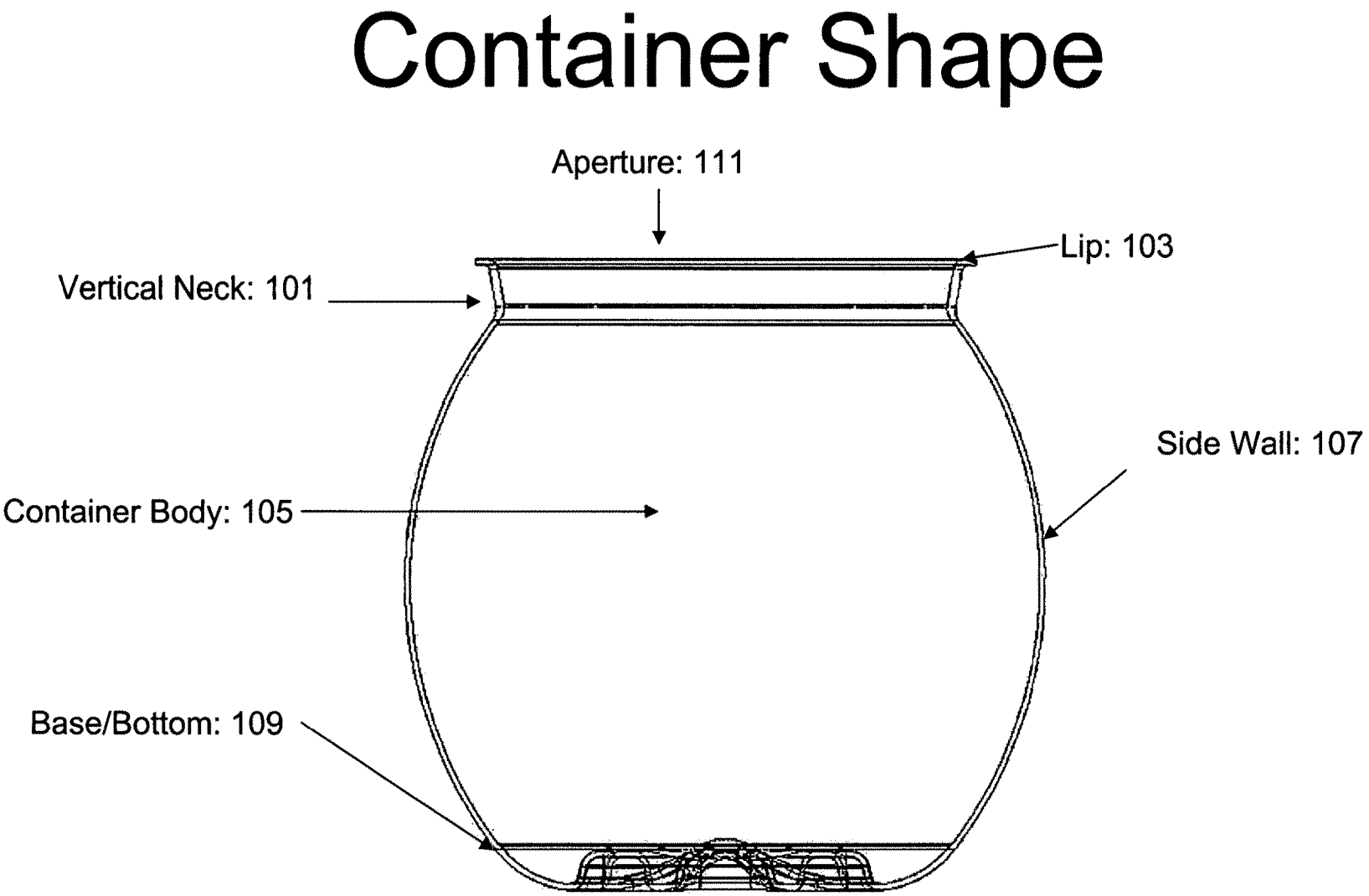
FIG. 1 illustrates a side view of the container body of the present invention.

FIG. 1 illustrates a side view of the container body 105 which may include a side wall 107 which may extend radially around a periphery of the container body 105 and may include a convex side wall 107 or a concave side wall (not shown). The container body 105 may be shaped as a truncated spherical body. The container body 105 may be hollow in order to provide for a solid or liquid which may be dispensed to the user.

The distal end of the container side wall 107 may be connected to abase/bottom wall 109 in order to seal the first end of the container 105 and the proximate end of the container side wall 107 may be connected to a substantially vertical neck 101 around the periphery of the container side wall 107. An aperture 111 may extend through the vertical neck 101 in order to provide access to the liquid/solid within the container body 105. A lip 103 may extend around the periphery of the substantially vertical neck 101 in order to cooperate with the lid 113 (Not shown on FIG. 1, but it is seen on FIGS. 4, 5, and 6) in order to provide a seal so that the liquid or solid within the container body 105 does not leak out.

The container body 105 according to the present invention may be made of an appropriate plastic/synthetic resin, typically polyethylene terephthalate (PET) resin. Alternatively, however, the container 105 may be made from polyamide resin, polycarbonate resin, polyacetal resin, polybuthylene terephthalate resin or other synthetic resin having a sufficient resistance to chemicals. The container may be formed by known molding processes, such as biaxial orientation blow molding process or direct blow molding process or injection blow molding.

Figure 2:
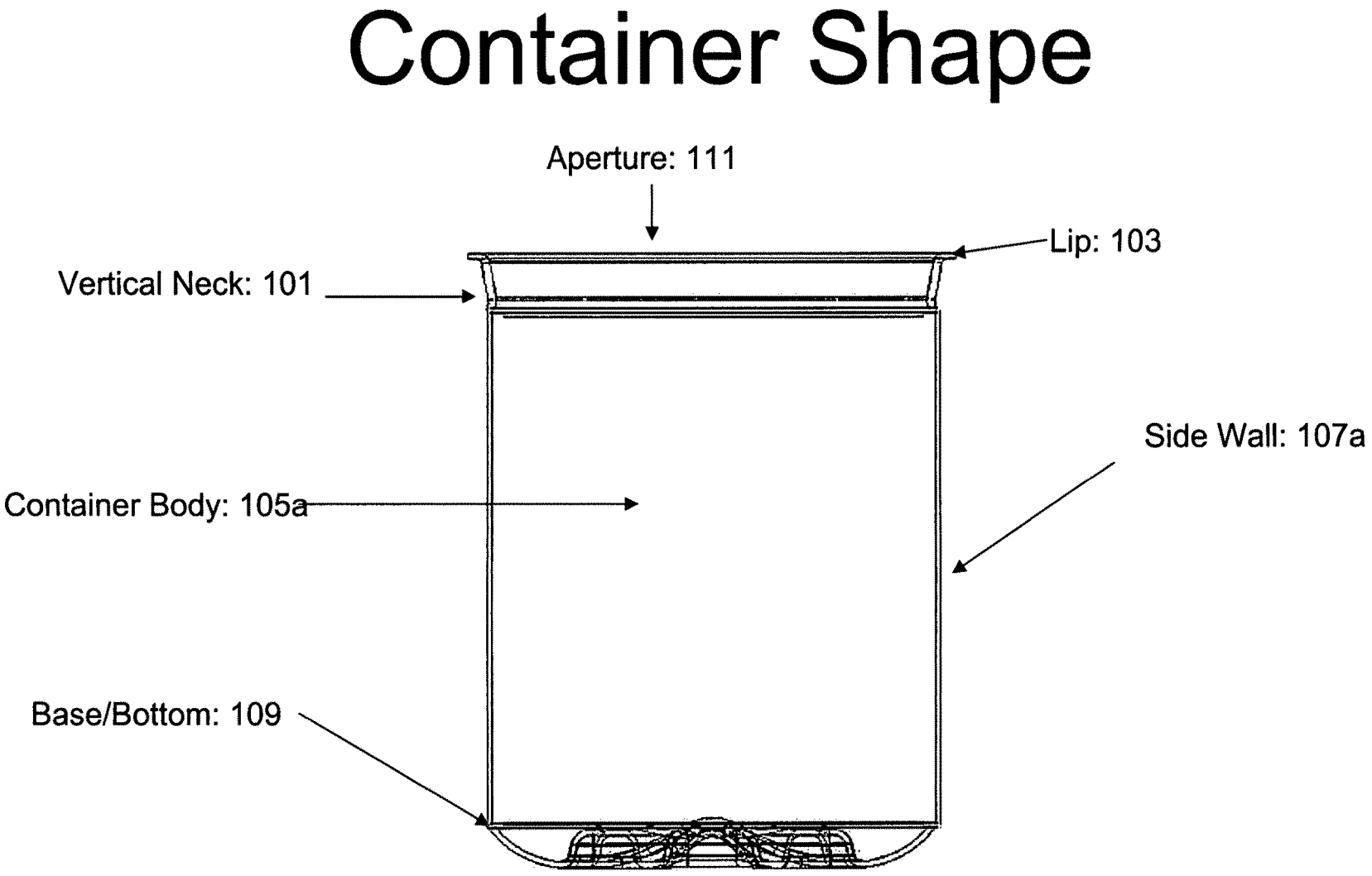
FIG. 2 illustrates a side view of another container body of the present invention.

FIG. 2 illustrates a side view of another container body **105*a* which may include a cylinder side wall 107*a* which may extend radially around a periphery of the container body 105*a* and may include a substantially vertical side wall 107*a*. The container body 105*a* may be hollow in order to provide for a solid or liquid which may be dispensed to the user. The distal end of the container side wall 107*a* may be connected to a base/bottom wall 109 in order to seal the first end of the container 105*a* and the proximate end of the container side wall 107*a* may be connected to a substantially vertical neck 101 around the periphery of the container side wall 107. An aperture 111 may extend through the vertical neck 101 in order to provide access to the liquid/solid within the container body 105. A lip 103 may extend around the periphery of the substantially vertical neck 101 in order to cooperate with the lid 113 (not shown in FIG. 2) in order to provide a seal so that the liquid or solid within the container body 105*a*** does not leak out.

The container body of **105*a*** may be formed from molded plastic and may be integral without seams or portions of the container body may be formed from molded plastic in sections which may be glued, welded or otherwise attached together.

The container body 105*a* according to the present invention may be made of an appropriate plastic/synthetic resin, typically polyethylene terephthalate (PET) resin. Alternatively, however, the container 105*a* may be made from polyamide resin, polycarbonate resin, polyacetal resin, polybuthylene terephthalate resin or other synthetic resin having a sufficient resistance to chemicals. The container may be formed by known molding processes, such as biaxial orientation blow molding process or direct blow molding process or injection blow molding.

Figure 3:
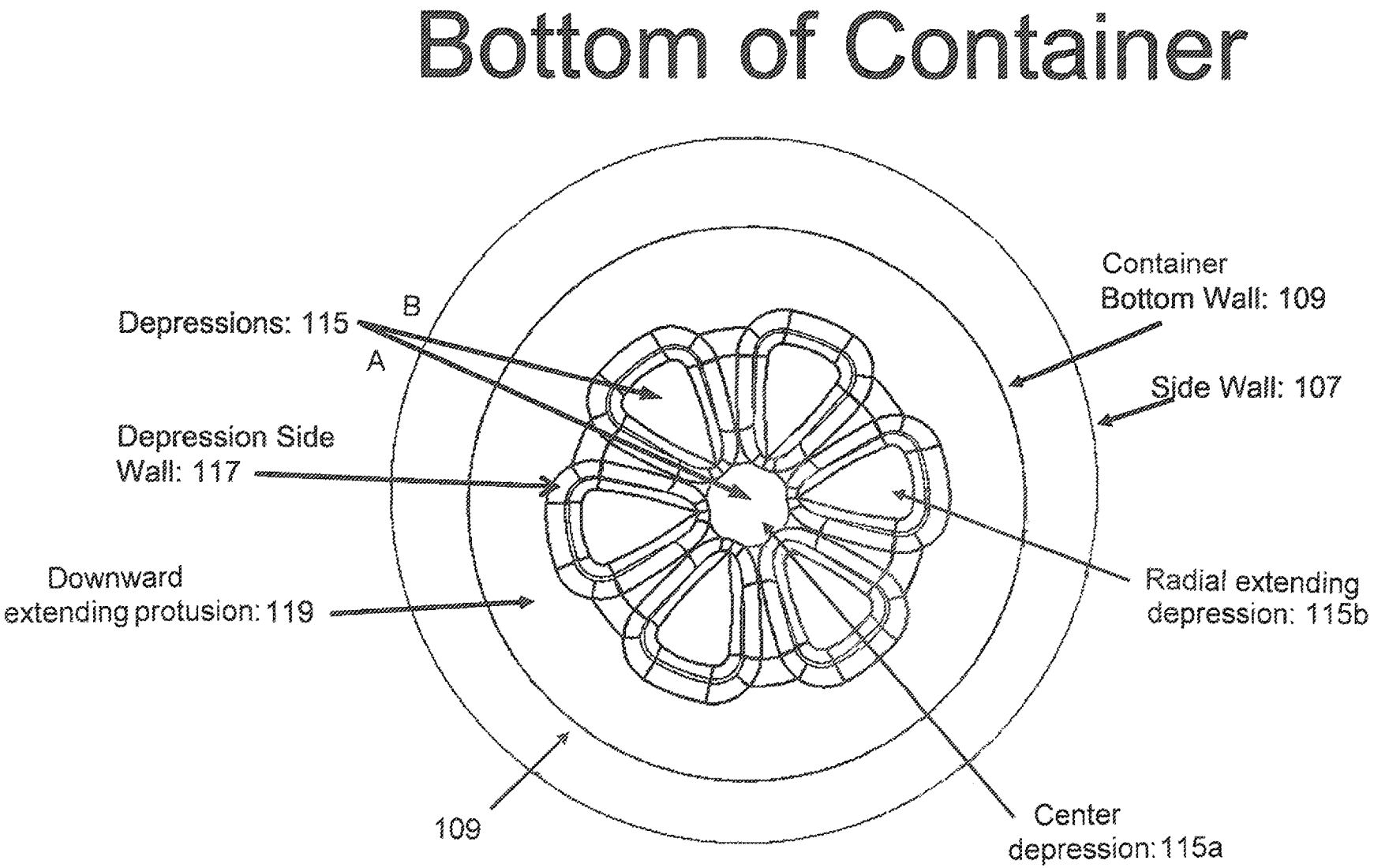
FIG. 3 illustrates a bottom view of the container body of the present invention.

FIG. 3 illustrates a bottom view of the container body and illustrates the container side wall 107 extending radially outwards and illustrates the bottom wall 109 which may be connected to the container side wall 107. The bottom wall 109 may include a multitude of radially extending depressions 115 which may increase in width as the radial distance from the center increases. The depression 115 may be defined by a depression side wall 117 which extends around the periphery of the depression 115. The bottom wall 109 may include a downward extending protrusion 119 which may be centered with respect to the depressions 115 and the bottom wall 109.

Figure 4:
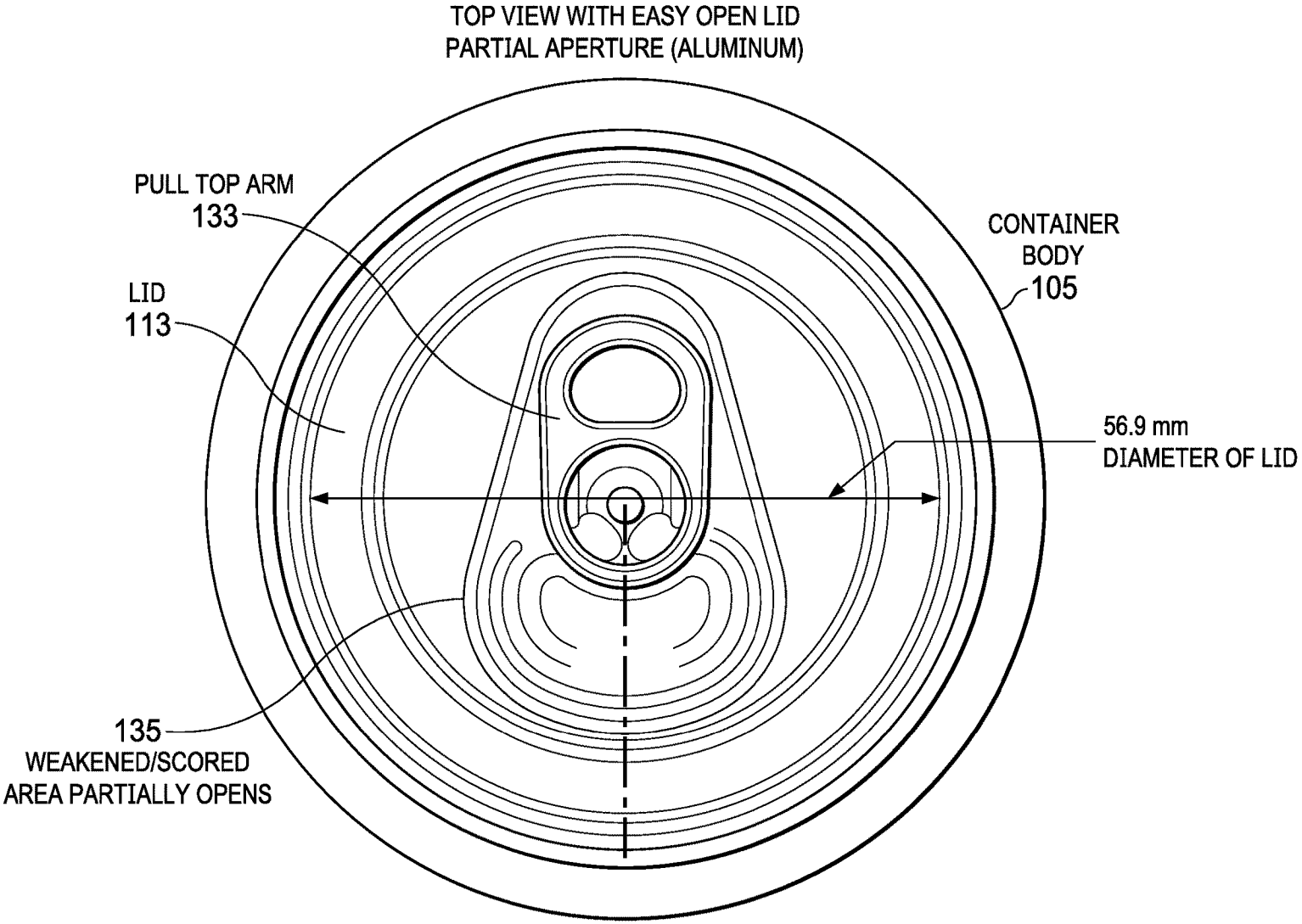
FIG. 4 illustrates a top view of the lids and container body of the present invention.

FIG. 4 illustrates a top view of the container which may include the container body 105 and the container lid 113 which may be deformable in order to provide access to the contents of the container body 105. The container lid 113 may be formed from metal such as steel, aluminum or other types of metals and may include a weakened (or scored) area 135 which deforms and provides an opening when the 'pull top' arm 133 which may include an aperture for a finger of the user and may be pivoted by the user. The weakened/scored area 135 may partially open to provide access to the contents of the container.

Figure 5:
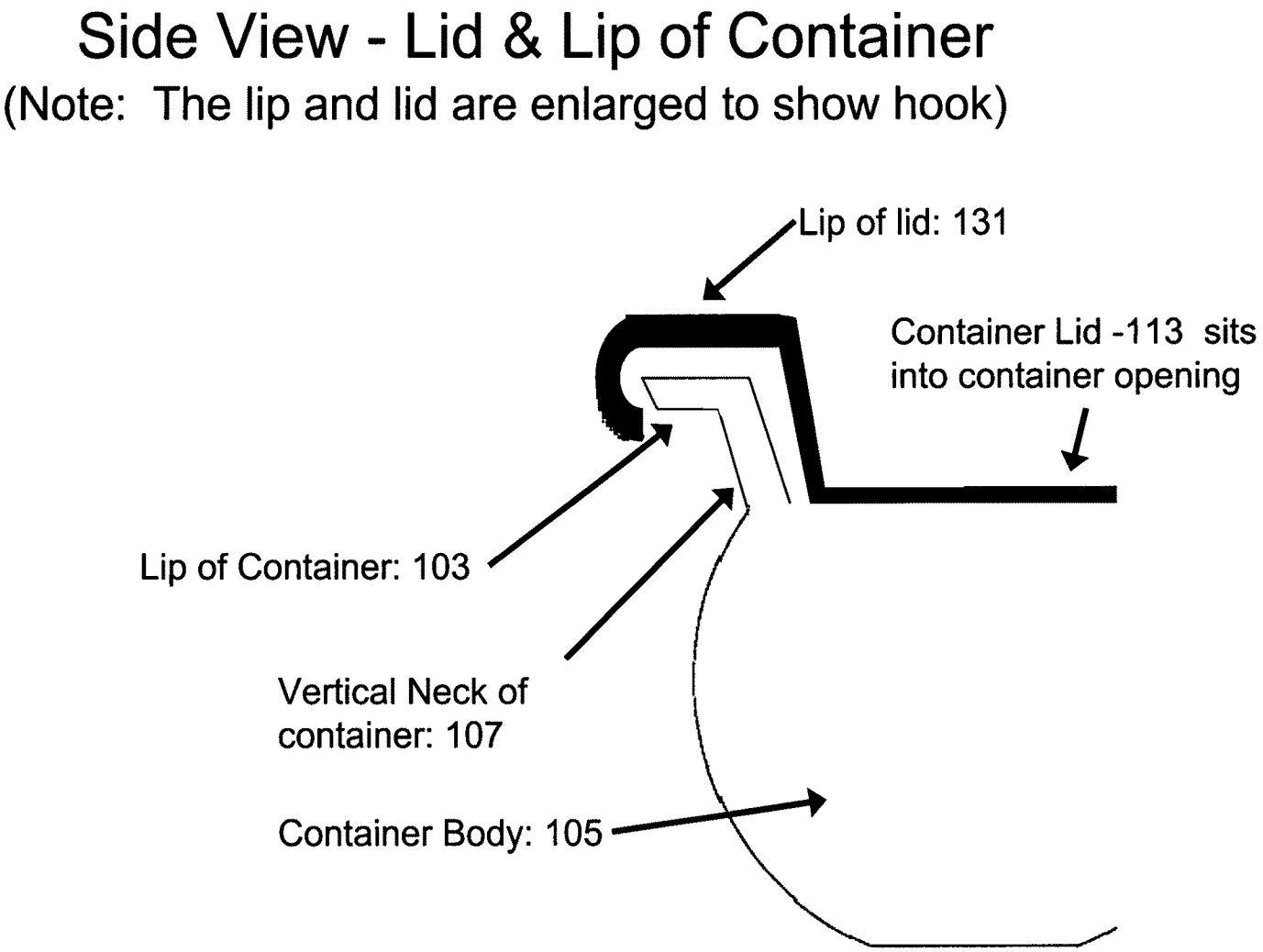
FIG. 5 illustrates a section of the lid and lip of the container body of the present invention.

FIG. 5 illustrates a side view of the container lid 103 which may extend over the vertical neck 107 and may extend around the lip 131 in order to provide a substantially watertight seal/airtight seal for the contents of the container body 105.

Figure 6:
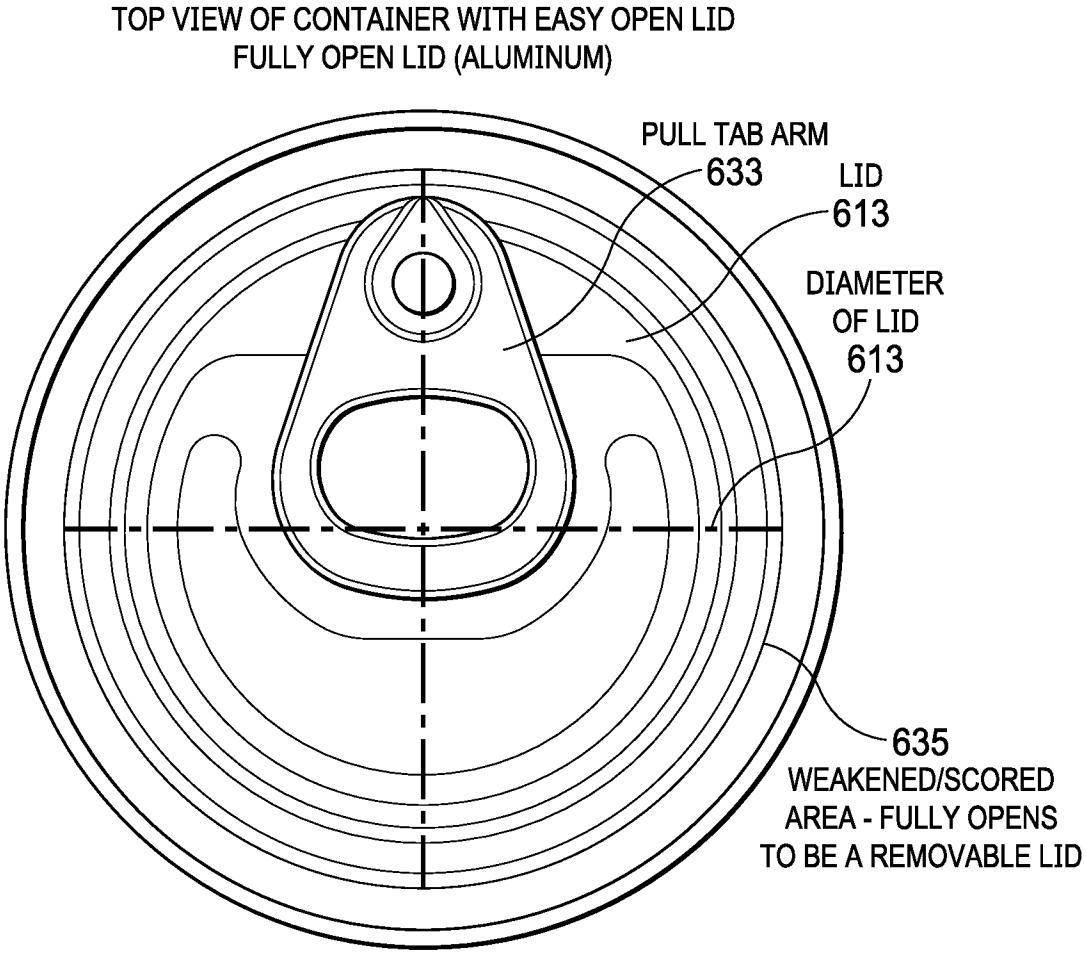
FIG. 6 illustrates another lid for the container body of the present invention.

FIG. 6 illustrates another container lid of the present invention. The container lid 613 may be formed from metal such as steel, aluminum or other types of metals and may include a weakened (or scored) area 635 which deforms and provides an opening when the 'pull tab' arm 633 which may include an aperture for a finger of the user and may be pivoted by the user. The weakened area 635 may extend substantially across the entire lid 613 to provide a full aperture lid to allow the user to add other contents to the container.

Figure 7:
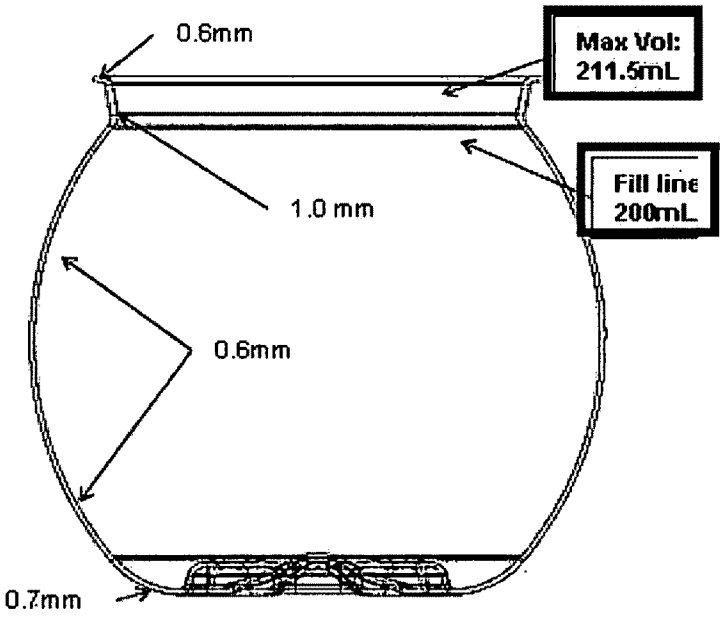
FIG. 7 illustrates the thicknesses of the plastic sidewalls, neck, and flange of the rounded container, and the volume of the rounded container.

FIG. 7 illustrates the thicknesses of the plastic sidewalls, neck and flange. This also illustrates the maximum volume of fluid, and the location for the "fill line" during the container filling process.

Figure 8:
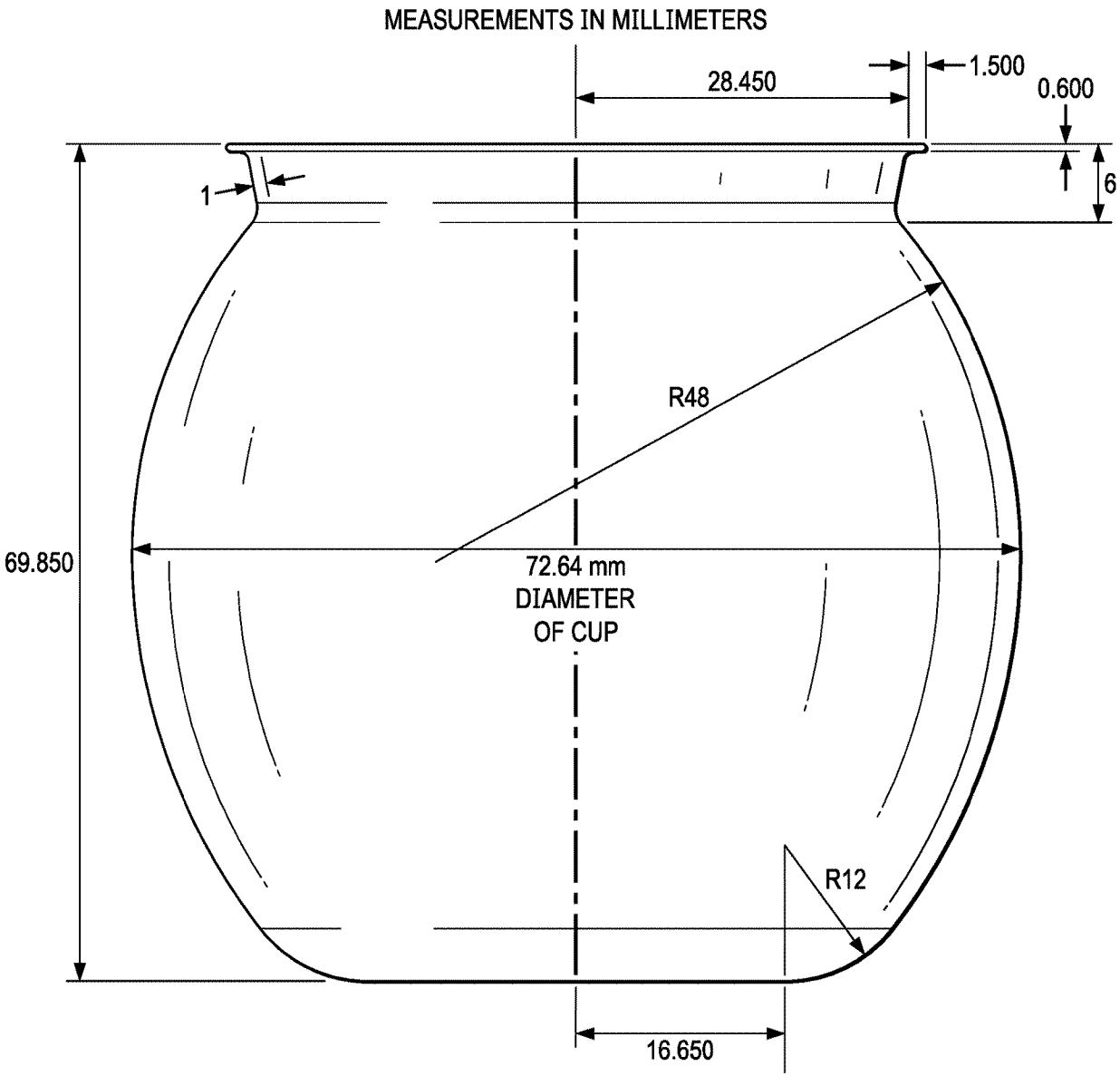
FIG. 8 illustrates the general dimensions of the rounded container in millimeters.

FIG. 8 illustrates the general dimensions of the rounded container in millimeters (cylindrical container measurements not shown from FIG. 2).

Figure 9:
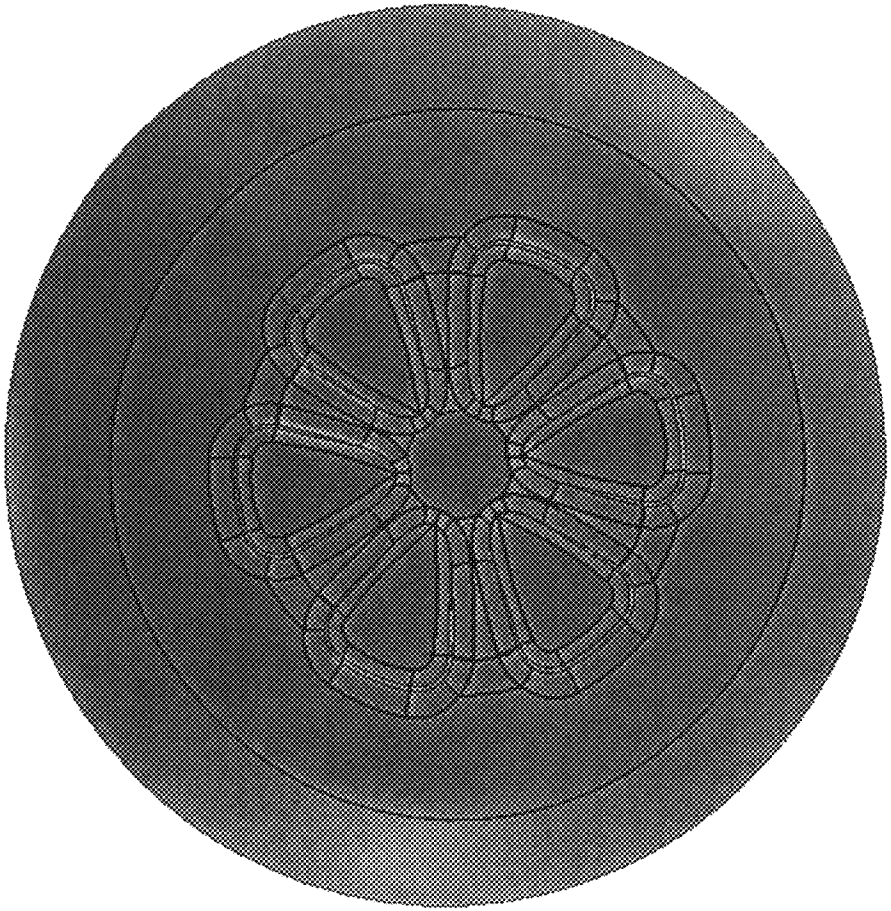
FIG. 9 illustrates a bottom view of the rounded container.

FIG. 9 illustrates the bottom view of the container.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A container, the container comprising a container body, the container body comprising a container side wall substantially convex in both the horizontal and vertical direction, the container body further comprising a horizontally-extending base connected to the container side wall, wherein the container side wall and the horizontally-extending base are shaped so that an interior of said container body has a truncated spherical shape, wherein a cross-sectional diameter of a top portion of said container body is less than a cross-sectional diameter of a middle portion of said container body, wherein the horizontally-extending base defines a diameter that is less than the cross-sectional diameter of the middle portion of said container body, wherein the container body further comprises a circular neck extending vertically from the container side wall so that the container side wall extends between the circular neck and the horizontally-extending base, wherein an upper edge of said container side wall is adjacent to the circular neck of the container body, wherein the container body further comprises a lip at the end of the circular neck opposite the upper edge of said container side wall, wherein said circular neck is adjacent to the lip, and wherein said container body defines an opening to the interior of said container body;

wherein the cross-sectional diameter of the top portion of said container body is defined by the circular neck;

wherein the cross-sectional diameter of the middle portion of said container body is defined by the container side wall;

wherein the container body is made out of a resin;

wherein the container body is formed using a blow molding process;

wherein the container side wall extends uninterruptedly between the circular neck and the horizontally-extending base;

wherein the container further comprises a lid connected to the container body and covering the opening to the interior of said container body;

wherein the lid is made out of a metal;

wherein a first portion of the lid extends on the lip of the container body;

wherein a second portion of the lid extends horizontally and is vertically offset from the first portion of the lid so that the second portion is located vertically between the first portion of the lid and the horizontally-extending base of the container body;

wherein the second portion of the lid comprises a weakened or scored area;

wherein the lid further comprises an arm connected to the second portion of the lid, the arm comprising an aperture to facilitate pivoting of the arm by a user; and wherein the arm is pivotable from a first position, in which the arm extends horizontally and the weakened or scored area is not deformed, to a second position, in which the arm does not extend horizontally and the weakened or scored area is deformed to provide an opening to the interior of said container body.

2. The container of claim 1, wherein the metal is aluminum.

3. The container of claim 1, wherein the resin is a polyethylene terephthalate (PET) resin.

4. The container of 1, wherein the base comprises a bottom wall and a depression formed therein.

* * * * *